US010807131B2

(12) United States Patent
Rindoks et al.

(10) Patent No.: US 10,807,131 B2
(45) Date of Patent: Oct. 20, 2020

(54) LABORATORY HOOD WITH VENTURI EFFECT AIR INTAKE DEVICE FOR ANTI-TURBULENT AIR FLOW CONTROL

(71) Applicant: Kewaunee Scientific Corporation, Statesville, NC (US)

(72) Inventors: Kurt P. Rindoks, Statesville, NC (US); Michael Pinkney Vaughn, Statesville, NC (US)

(73) Assignee: Kewaunee Scientific Corporation, Statesville, NC (US)

( * ) Notice: Subject to any disclaimer, the term of this patent is extended or adjusted under 35 U.S.C. 154(b) by 268 days.

(21) Appl. No.: 15/144,038

(22) Filed: May 2, 2016

(65) Prior Publication Data

US 2017/0312797 A1 Nov. 2, 2017

(51) Int. Cl.
*B08B 15/02* (2006.01)
*B25H 1/20* (2006.01)
(Continued)

(52) U.S. Cl.
CPC ..... *B08B 15/023* (2013.01); *B01L 1/04* (2013.01); *B25H 1/20* (2013.01); *F24F 3/1607* (2013.01); *B01L 2200/082* (2013.01)

(58) Field of Classification Search
CPC ..... B01L 2200/082; B25H 1/20; F24F 3/1607
(Continued)

(56) References Cited

U.S. PATENT DOCUMENTS 2,649,727 A * 8/1953 Snow ..... B08B 15/023 454/57
2,819,666 A * 1/1958 McNeil ..... B08B 15/023 454/59

(Continued)

FOREIGN PATENT DOCUMENTS

GB 1146778 A * 3/1969 ..... B08B 15/023
GB 1146778 A * 3/1969 ..... B08B 15/023

OTHER PUBLICATIONS

Ashrae, "Methods of Testing Performance of Laboratory Fume Hoods", ANSI/ASHRAE Standard 110-2016, pp. 16-17, all enclosed pages cited.

*Primary Examiner* — Edelmira Bosques
*Assistant Examiner* — Frances F. Hamilton
(74) *Attorney, Agent, or Firm* — Nelson Mullins Riley & Scarborough LLP

(57) ABSTRACT

In a laboratory hood system having a housing with an access window opening into an interior work chamber for performing laboratory processes, and an air circulation system for creating an air flow from the laboratory environment inwardly through the access window into the work chamber for preventing hazardous materials from escaping into the laboratory environment through the access window, one or more air intake control devices are disposed in a selected location or locations at the access window to overcome any tendency for air turbulence to occur. The air intake control device has an air flow channel extending from an air intake opening to the laboratory environment to an air discharge
(Continued)

opening to the work chamber, with a constriction in the channel for causing a venturi-effect increase in air velocity while flowing through the channel to promote non-turbulent air flow entering the work chamber at the selected location or locations.

10 Claims, 3 Drawing Sheets

(51) Int. Cl.
*F24F 3/16* (2006.01)
*B01L 1/04* (2006.01)

(58) Field of Classification Search
USPC ..... 454/55, 56, 58, 61, 64, 66
See application file for complete search history.

(56) References Cited

U.S. PATENT DOCUMENTS 3,425,335 A * 2/1969 Black ..... B08B 15/023 454/57
3,747,504 A * 7/1973 Turko ..... B08B 15/023 454/59
3,752,056 A * 8/1973 Chamberlin ..... B08B 15/023 454/59
4,023,473 A * 5/1977 Russell ..... B08B 15/023 454/59
4,043,319 A * 8/1977 Jensen ..... B08B 15/023 126/299 D
4,211,154 A * 7/1980 Eakes ..... B08B 15/02 126/299 D
4,215,627 A 8/1980 Garriss
4,280,400 A * 7/1981 Longworth ..... B08B 15/023 454/57
4,856,420 A * 8/1989 Poblete ..... B08B 15/023 454/59
5,215,497 A 6/1993 Drees
5,407,389 A * 4/1995 Poblete ..... B08B 15/023 454/56
5,447,468 A 9/1995 Tener et al.
5,664,995 A * 9/1997 O'Keefe ..... B08B 15/023 454/58
5,697,838 A 12/1997 Morris
5,797,790 A 8/1998 Rindoks et al.
5,924,920 A * 7/1999 DeLuca ..... B08B 15/023 454/61
6,089,970 A 7/2000 Feustel
6,350,194 B1 * 2/2002 Haugen ..... B08B 15/023 454/56
6,421,875 B1 * 7/2002 Coombs ..... A47L 9/02 15/415.1
6,428,408 B1 * 8/2002 Bell ..... B01L 1/50 454/56
6,461,233 B1 10/2002 Gilkison et al.
6,582,292 B1 6/2003 Bastian
6,871,170 B2 3/2005 Ryan et al.
6,994,619 B2 2/2006 Scholten
7,001,263 B2 2/2006 Shaben
7,217,183 B2 * 5/2007 Ryan ..... B08B 15/023 454/56
7,247,087 B1 * 7/2007 Poblete ..... F24C 15/20 126/299 F
7,318,771 B2 1/2008 Huang et al.
7,337,494 B2 * 3/2008 Baer ..... A47L 9/06 15/246.2
7,409,742 B2 * 8/2008 Song ..... A47L 9/02 15/326
7,470,176 B2 * 12/2008 Morris ..... B08B 15/023 454/61
8,475,244 B2 7/2013 Wright
9,056,339 B2 * 6/2015 Smith ..... B08B 15/02
2003/0109211 A1 * 6/2003 Bastian ..... F23L 3/00 454/56
2004/0242143 A1 * 12/2004 Gartner ..... B08B 15/023 454/58
2008/0223759 A1 * 9/2008 Schneider ..... B07B 4/02 209/143
2008/0278040 A1 * 11/2008 McCarthy ..... B01L 1/04 312/209
2008/0318514 A1 * 12/2008 Fettkether ..... F24F 13/0218 454/330
2012/0052784 A1 * 3/2012 Smith ..... B08B 15/02 454/56
2012/0322353 A1 * 12/2012 Christopherson ..... F24F 3/1607 454/56
2013/0183893 A1 * 7/2013 Gartner ..... B08B 15/023 454/66

* cited by examiner

LABORATORY HOOD WITH VENTURI EFFECT AIR INTAKE DEVICE FOR ANTI-TURBULENT AIR FLOW CONTROL

FIELD OF THE INVENTION

The present invention relates generally to laboratory hoods, sometimes referred to as fume hoods, providing a confined work chamber in which laboratory processes may be performed and, more particularly, to means for controlling the flow of ambient air from the laboratory environment into such hoods.

BACKGROUND OF THE INVENTION

Laboratory hoods of varying configurations are widely known in the prior art. Such hoods are commonly used in laboratories in both educational institutions and in diverse industries, e.g. chemical, medical, and pharmaceutical industries, to provide a confined work chamber in which scientists may perform various scientific tests, reactions, and experiments while protecting the scientist and the ambient laboratory environment from exposure to potentially dangerous contaminants, such as hazardous chemicals, toxic or noxious fumes, reaction byproducts, and the like.

In its basic form, a typical laboratory hood has a work chamber which is substantially enclosed, but which includes an access window sufficient for a scientist, technician or other operator to reach into the work chamber through the window in order to perform laboratory processes within the work chamber. An air circulation system draws a continuous flow of air from the ambient laboratory environment through the access window into the work chamber and then exhausts the air through an exhaust system, including one or more filters, which usually discharges to outside the laboratory. Thus hazardous materials may be handled safely within the work chamber of the hood without endangering the operator or others in the laboratory environment.

It is important in the operation of such laboratory hoods that air entering the work chamber through the access window flow uniformly and non-turbulently through the window and interiorly across the work chamber. Most laboratory hoods have a sloped or curved surface forming the lower border of the access opening and merging into a bottom wall within the work chamber to act in the nature of an air foil to channel incoming ambient air into and across the work chamber. Such air foil surfaces mostly perform satisfactorily for the intended purpose across the predominant widthwise extent of the surface. However, at the ends of the air foil surfaces which adjoin vertical side walls of the hood, incoming ambient air can stagnate, become turbulent and/or flow more slowly than along the predominant length of the air foil surface. This effect is sometimes referred to in the industry as "lazy air," and can produce a risk that air and entrained contaminants within the work chamber do not exhaust from the work area and/or that air can flow outwardly from the work chamber and carry with it contaminants from the work chamber. A need therefore exists for an improved means of controlling air flow entering a laboratory hood to overcome any localized area or areas of air turbulence.

SUMMARY OF THE INVENTION

The present invention seeks to overcome the foregoing disadvantages in known laboratory hoods. Basically, the present invention is adapted to substantially any laboratory hood system having a housing defining an interior work chamber for performance therein of laboratory processes, with an access window opening from the laboratory environment into the work chamber and an exhaust outlet spaced from the access window, and wherein an air circulation system creates an air flow from the laboratory environment inwardly through the access window into the work chamber and therefrom to the exhaust outlet, for preventing hazardous materials from passing from the work chamber into the laboratory environment through the access window.

According to the invention, an air intake control device is disposed in a selected location at the access window at which air turbulence or stagnation may occur. The air intake control device defines an air flow channel between an air intake which opens to the laboratory environment and an air discharge which opens to the work chamber for air flow from the laboratory environment through the air flow channel and into the work chamber. The air flow channel has a constriction for causing a venturi-effect increase in velocity of air while flowing through the air flow channel for deterring turbulence in the air flow entering the work chamber at the selected location.

According to one aspect of the invention, the air intake control device may be selectively disposed at a corner area within the access window. For example, one such air intake control device may be disposed at each corner formed between a bottom wall and opposed side walls of the housing.

The constriction in the air intake control device is preferably adjacent the air discharge. In a contemplated embodiment, the air flow channel of the air intake control device may be configured to narrow progressively from the air intake to the constriction.

DETAILED DESCRIPTION OF THE PREFERRED EMBODIMENTS

Figure 1:
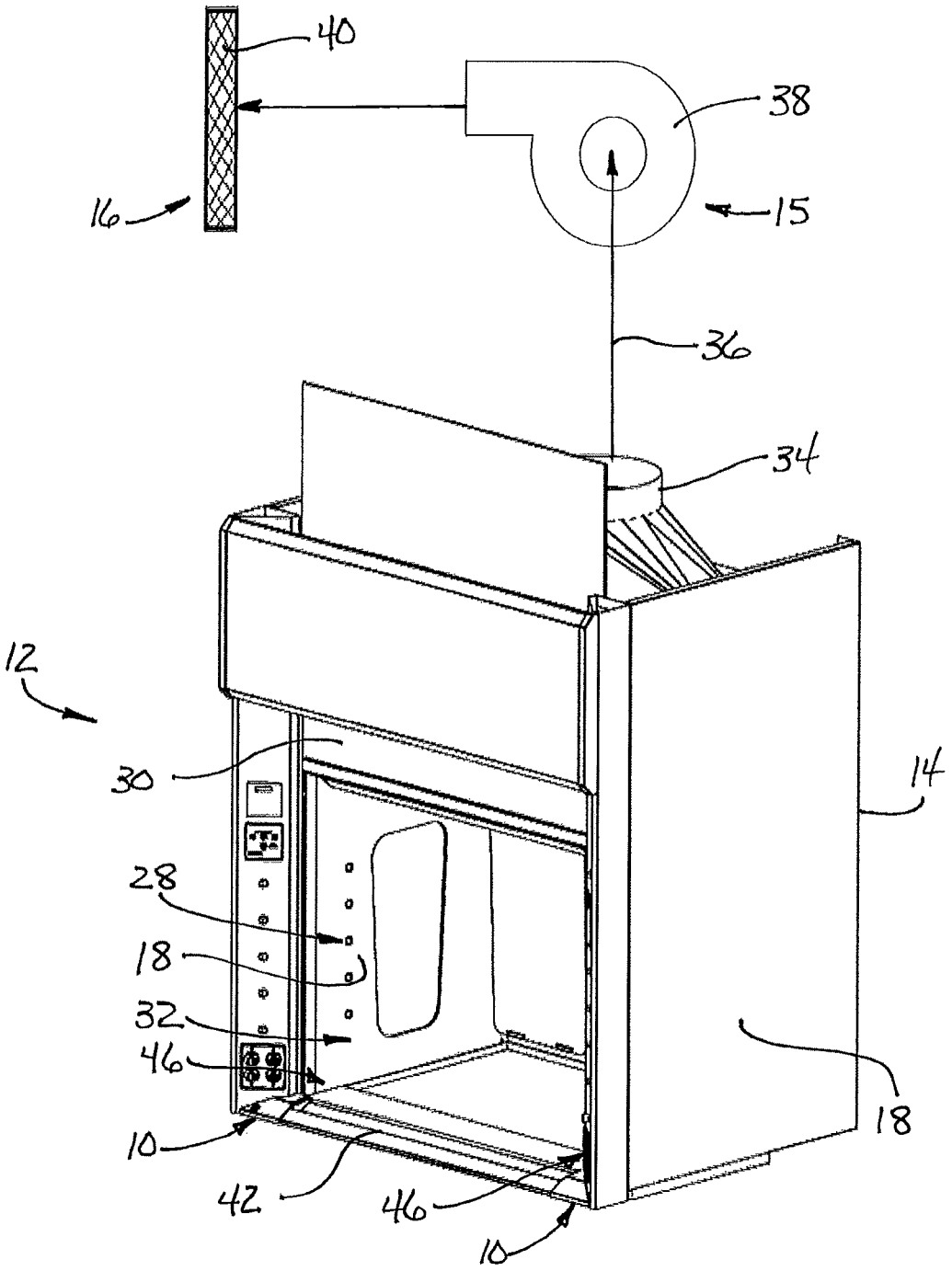
FIG. 1 is a front perspective view of a laboratory hood equipped with air intake control devices in accordance with of the present invention.
Figure 3:
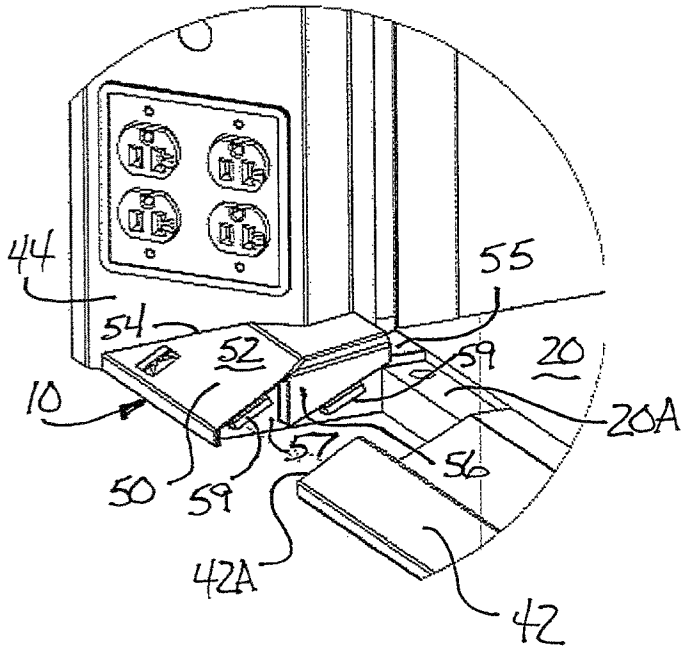
FIG. 3 is a partially enlarged and exploded perspective view of the laboratory hood of FIGS. 1 and 2 at the air intake control device in FIG. 2 as indicated at B in FIG. 2.
Figure 2:
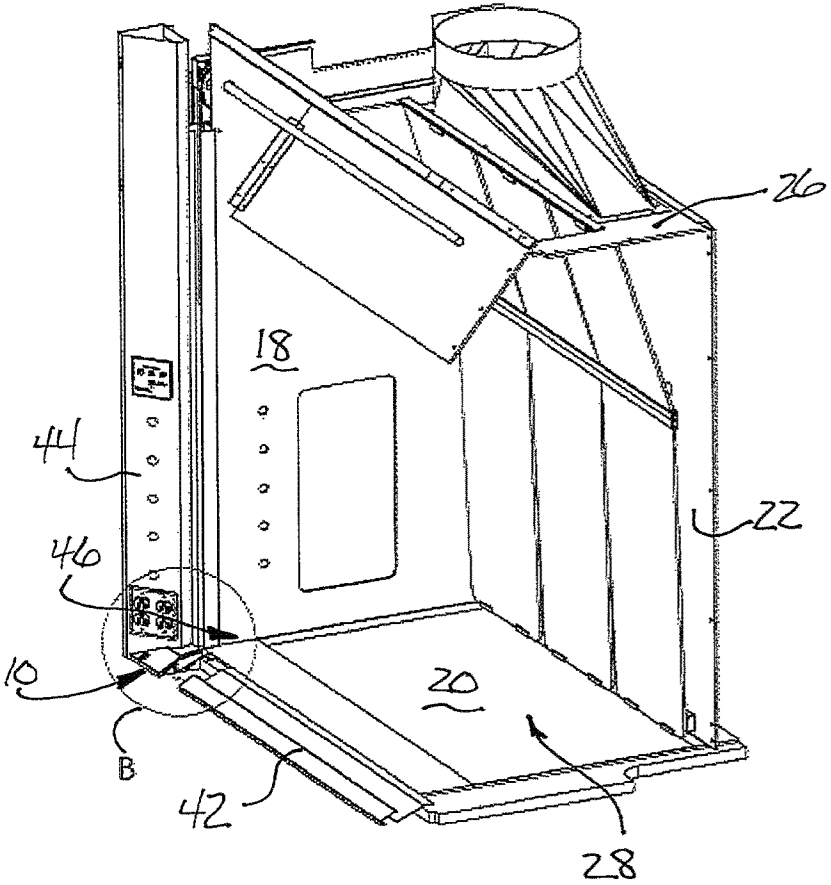
FIG. 2 is another front perspective view of the laboratory hood of FIG. 1, partially cutaway and exploded to show the interior work chamber and one air intake control device.
Figure 5:
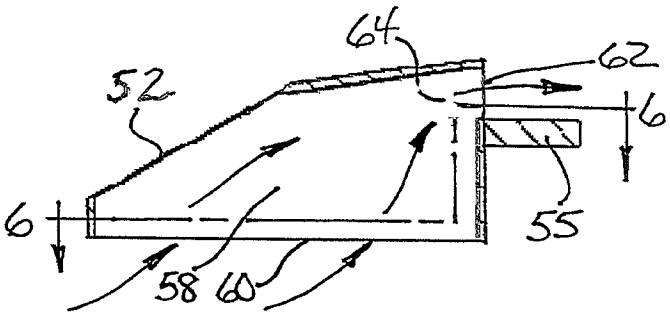
FIG. 5 is a vertical cross-sectional view of the air intake control device in FIGS. 2-4, taken along line 5-5 of FIG. 4.
Figure 4:
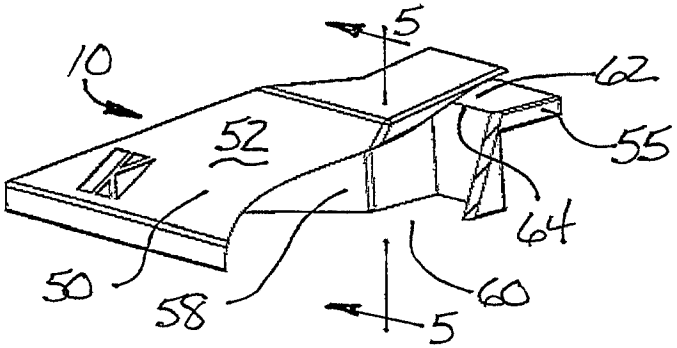
FIG. 4 is a partially cutaway perspective view of the air intake control device in FIGS. 2 and 3.
Figure 6:
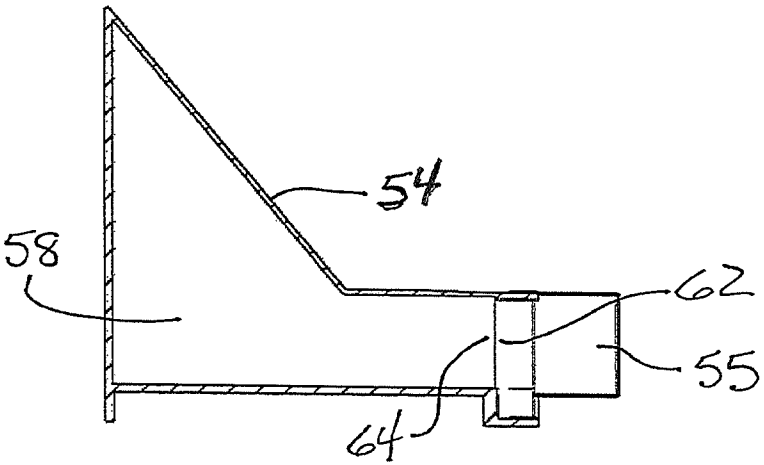
FIG. 6 is a horizontal cross-sectional view of the air intake control device in FIGS. 2-4, taken along line 6-6 of FIG. 5.

Referring now to the accompanying drawings and initially to FIGS. 1 and 2, air intake control devices in accordance with the present invention are indicated generally at 10 as embodied in a representative laboratory hood system of the type commonly know as a fume hood, indicated generally at 12. The laboratory hood system 12 basically comprises a housing 14, an air circulation system 15 and a filtration system 16.

The housing 14 is a generally rectangular structure having spaced-apart side walls 18, a bottom wall 20, a rear wall 22, and a top wall 26, collectively defining an interior work chamber 28 suitable for performance therein of laboratory processes. The housing 14 may preferably be fabricated of sheet metal, such as stainless steel. A transparent sash 30 is supported between the side walls 18 at the front of the housing 14 for upward and downward sliding movement to selectively open and close access into the work chamber 28. In normal operation, the sash 30 is in an upward position providing a front access window 32 opening into the work chamber 28 between the bottom wall 20 and the lower edge of the sash 30 through which users may have manual access into the work chamber 28. The transparency of the sash 30 permits visual access into the work chamber 28 by users. The housing 12 also includes an exhaust outlet 34 opening in the top wall 26 and connected to an exhaust duct indicated only schematically at 36.

The air circulation system 15 comprises a fan or blower, indicated only schematically at 38, connected to the exhaust duct 36 to cause an airstream to flow from the ambient laboratory environment inwardly through the access window 32 into and through the work chamber 28 and then outwardly through the exhaust outlet 34 and exhaust duct 36 to a predetermined discharge location. This arrangement maintains a negative pressure environment within the work chamber 28 to prevent toxic or noxious contaminants from passing from the work chamber 28 into the laboratory environment through the access window 32. The filtration system 16 comprises one or more filters, indicated only schematically at 40, which may be disposed in the housing 14 or in the exhaust duct 36, either upstream or downstream of the fan or blower 38, to remove contaminants entrained in the airstream before discharge.

The housing 14 further includes an angled or tapered airfoil 42 along the forwardmost edge of the bottom wall 20 bordering the lower margin of the access window 32 and similarly angled or tapered fascia members 44 along the respective forwardmost edges of the sidewalls 18 bordering the left and right margins of the access window 32, to promote relatively smooth non-turbulent flow of ambient laboratory air into the work chamber 28. As previously noted, conventional laboratory hoods are known to suffer stagnation and/or turbulence in the incoming air stream entering the work chamber at corners of the access window where the bottom wall adjoins the sidewalls, as indicated at 46 in FIG. 1. In the present invention, a pair of air intake control devices 10 are mounted between opposite ends of the airfoil 42 and the respective fascia members 44 outwardly adjacent the corner areas 46 at which the bottom wall 20 adjoins the sidewalls 18. The air intake control devices 10 are of mirror image configurations to permit each air intake control device to be mounted in lateral abutment with the airfoil surface 42 in close conformity thereto and in conforming abutment to the adjacent fascia surfaces 44.

As best seen in FIGS. 3-6, each air intake control device 10 comprises a main body 50 having a top surface 52 of a profiled configuration substantially matching that of the airfoil 42, a laterally outwardly-facing side abutment surface 54 of a profiled configuration in conformity to the surface configuration of the adjacent adjoining fascia member 44, and a laterally inwardly-facing side surface 56 configured for abutted connection with one of the respective end edges 42A of the air foil 42. A mounting tab 55 projects from the forward end of the main body 50 and is affixed in a recess 20A within the bottom wall 20 of the housing 14 to merge smoothly with the bottom wall 20. The inwardly-facing side surface 56 includes a recessed area 57 configured in conformity to the respective end edge 42A of the air foil 42 and includes a pair of mounting tabs 59 for positioning the air foil end edge within the recess 57.

Each air intake control device 10 has a hollow interior forming a continuous airflow channel 58 extending from an enlarged air intake 60 at the downwardly facing underside of the main body 50 opening toward the ambient laboratory environment to an air discharge 62 at the inwardly facing side of the main body 50 immediately above the mounting tab 55 opening toward the work chamber 28. The air flow channel 58 progressively narrows in cross-sectional area from the air intake 60 to a constriction 64 at the air discharge 62. As a result, the air steam induced by the fan or blower 38 draws ambient laboratory air in the regions below the corner areas 46 upwardly through the air flow channels 58 of the two air intake control devices 10 and into the work chamber 28, as represented by the directional arrows in FIG. 5. Owing to the narrowing configuration of the air flow channels 58 a venturi-effect in created at the constrictions 64 in the channels 58 causing the velocity of the air stream to increase while flowing therethrough and, in turn, as the accelerating air stream is emitted from the discharges 62 in the corner areas 46, the air stream overcomes any tendency for air within the corner areas to become turbulent or to otherwise move outwardly toward the ambient laboratory environment.

As will be understood, although the air intake control devices 10 are depicted and described in a contemplated embodiment wherein the devices are located at corners 46 of the access window 32, it is contemplated that air intake control devices in accordance with the present invention can be configured and disposed at substantially any other location or locations within or along the access window at which air turbulence or "lazy air" may occur.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

What is claimed is:

1. A laboratory hood system for performance of laboratory processes within a contained area, comprising:

(a) a housing defining an interior work chamber for performance therein of laboratory processes, the housing including an access window opening from the ambient laboratory environment into the work chamber and an exhaust outlet spaced from the access window, (b) an air flow system for creating an air flow from the laboratory environment inwardly through the access window into the work chamber and therefrom to the exhaust outlet, for preventing hazardous materials from passing from the work chamber into the laboratory environment through the access window, and (c) an air intake control device disposed in a selected location at the access window, the air intake control device comprising:

a main body having a top surface of a first profiled configuration, a laterally outwardly-facing side abutment surface of a second profiled configuration, a laterally inwardly-facing side surface, an inwardly facing side, a mounting tab to be fixed in a bottom of the housing, the inwardly facing side extending downwardly from, and orthogonal to, the mounting tab;

the laterally inwardly-facing side surface includes a first and second recessed area;

the recessed area comprises a pair of mounting tabs for aligning the air intake control device with an airfoil of the laboratory hood system;

wherein the top surface, the laterally outwardly-facing side abutment surface and the laterally inwardly-facing side surface of the air intake control device form a hollow interior of a continuous airflow channel;

the airflow channel extending from an air intake at a downwardly facing underside of the main body to an air discharge at the inwardly facing side of the main body;

and the air discharge formed orthogonally to the air intake;

wherein the air flow channel extends from the air intake that is open towards the laboratory environment to the air discharge that is open towards the work chamber for air flow from the laboratory environment through the air flow channel and into the work chamber, the air flow channel having a constriction for causing a venturi-effect increase in velocity of air while flowing through the air flow channel for deterring turbulence in the air flow entering the work chamber at the selected location.

2. The laboratory hood system according to claim 1, wherein the housing defines a corner area within the access window, the air intake control device being disposed at the corner area.

3. The laboratory hood system according to claim 1, wherein the housing includes a bottom wall and opposed side walls defining the work chamber and forming spaced-apart corners and the air intake control device is disposed at each corner formed between the bottom wall and the opposed side walls of the housing.

4. The laboratory hood system according to claim 3, wherein the housing further comprises a tapered fascia member along a forwardmost edge of the sidewalls bordering left and right margins of the access window.

5. The laboratory hood system according to claim 3, wherein the air intake control devices are mirror image configurations.

6. The laboratory hood system according to claim 1, wherein the constriction is adjacent the air discharge.

7. The laboratory hood system according to claim 6, wherein the air flow channel of the air intake control device narrows progressively from the air intake to the constriction.

8. The laboratory hood system according to claim 1, wherein the laterally inwardly-facing side surface is configured for abutted connection with a respective end edge of an air foil.

9. The laboratory hood system according to claim 1, wherein the mounting tab projects from a forward end of the main body.

10. An air intake control device comprising a main body having a top surface, a first lateral side surface, a second lateral side surface, a mounting tab extending from the main body in a direction of air flow, a side extending downwardly from, and orthogonal to, the mounting tab;

the second lateral side surface includes a first and second recessed area;

the first and second recessed areas each comprising a tab for aligning the device within an exhaust system;

wherein the top surface, the first lateral side surface and the second lateral side surface of the air intake control device form a hollow interior of a continuous airflow channel;

the airflow channel extending from an air intake at a downwardly facing underside of the main body to an air discharge located directly above the mounting tab;

and the air discharge formed orthogonally to the air intake.

* * * * *